US006662602B1

(12) United States Patent
Carl

(10) Patent No.: US 6,662,602 B1
(45) **Date of Patent: *Dec. 16, 2003**

(54) SECURITY DEVICE FOR A PORTABLE COMPUTER

(75) Inventor: Stewart R. Carl, Palo Alto, CA (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/595,766

(22) Filed: Jun. 16, 2000

Related U.S. Application Data

(63) Continuation of application No. 08/744,890, filed on Nov. 8, 1996, now Pat. No. 6,112,561.

(51) Int. Cl.[7] ..... E05B 69/00
(52) U.S. Cl. ..... 70/58; 70/14
(58) Field of Search ..... 70/14, 18, 423, 70/424, 58

(56) References Cited

U.S. PATENT DOCUMENTS

| | | | | |
|---|---|---|---|---|
| 87,045 | A | 3/1869 | Dante | |
| 505,299 | A | 9/1893 | Schneider | |
| 606,734 | A | 7/1898 | Olmstead | |
| 611,646 | A | 10/1898 | Parker | |
| 786,842 | A | 4/1905 | Robeson | |
| 881,364 | A | 3/1908 | Wheeler | |
| 934,928 | A * | 9/1909 | Michel | 70/423 |
| 942,537 | A | 12/1909 | Batdorf | |
| 952,411 | A | 3/1910 | Billy | |
| 1,452,471 | A | 4/1923 | Kline | |
| 1,470,937 | A | 10/1923 | Schou | |
| 1,534,936 | A | 4/1925 | Fischbach | |
| 1,672,333 | A | 6/1928 | Miller | |
| 1,786,511 | A | 12/1930 | Warren | |
| 2,130,216 | A | 9/1938 | Zaninovich | |

(List continued on next page.)

FOREIGN PATENT DOCUMENTS

| | | |
|---|---|---|
| CA | 454901 | 3/1949 |
| CA | 791364 | 8/1968 |
| DE | 335741 | 4/1921 |
| DE | 361068 | 4/1923 |
| DE | 3627334 | 7/1987 |

(List continued on next page.)

OTHER PUBLICATIONS

Kablit Security System Catalog, pp. 7, 93, 1988. *Computer and Office Equipment Security Catalog*, ©1990 by Secure–It, Inc., 18 Maple Court, East Longmeadow, MA 01028.

(List continued on next page.)

*Primary Examiner*—Gary Estremsky
(74) *Attorney, Agent, or Firm*—Townsend, Townsend & Crew LLP

(57) ABSTRACT

An apparatus which inhibits the theft of equipment such as personal computers is disclosed. In a preferred embodiment, a locking interface for the specially designed slot includes two legs pivotably coupled together about an articulation point. The two legs each have opposing flanges on a first end and handles on a second end. The two legs define a first and a second position, with the flanges and legs adapted for insertion and removal when in the first position. The flanges engage an inner surface of the wall when the legs are in the second position. The preferred embodiment includes a retainer that is coupled to the handles of the first and second legs that retain the legs in the second position when the flanges engage the inner surface. In the preferred embodiment, the handles define an aperture and an object extends through the aperture to hold the legs in the second position. The object may be any suitable object, including a cable or shackle of a lock.

12 Claims, 2 Drawing Sheets

U.S. PATENT DOCUMENTS

| | | | | | |
|---|---|---|---|---|---|
| 2,190,661 | A | | 2/1940 | Hauer | |
| 2,383,397 | A | | 8/1945 | Lofquist | |
| 2,469,874 | A | | 5/1949 | Fetsko, Jr. | |
| 2,480,662 | A | | 8/1949 | McKinzie | |
| 2,594,012 | A | | 4/1952 | Griffin | |
| 2,660,084 | A | | 11/1953 | Newman | |
| 2,677,261 | A | | 5/1954 | Jacobi | |
| 2,729,418 | A | | 1/1956 | Maynard | |
| 2,800,090 | A | | 7/1957 | Reid | |
| 2,963,310 | A | | 12/1960 | Abolins | |
| 3,091,011 | A | | 5/1963 | Campbell | |
| 3,101,695 | A | | 8/1963 | Honeyman, Jr. | |
| 3,130,571 | A | | 4/1964 | Neumann | |
| 3,136,017 | A | | 6/1964 | Preziosi | |
| 3,171,182 | A | | 3/1965 | Danehy | |
| 3,200,694 | A | | 8/1965 | Rapata | |
| 3,220,077 | A | | 11/1965 | Newcomer, Jr. et al. | |
| 3,276,835 | A | | 10/1966 | Hall | |
| 3,469,874 | A | | 9/1969 | Mercurio | |
| 3,521,845 | A | | 7/1970 | Sweda et al. | |
| 3,590,608 | A | | 7/1971 | Smyth et al. | |
| 3,634,963 | A | | 1/1972 | Hermann | |
| 3,664,163 | A | | 5/1972 | Foote | |
| 3,722,239 | A | | 3/1973 | Mestre | |
| 3,727,934 | A | | 4/1973 | Averbook et al. | |
| 3,737,135 | A | | 6/1973 | Bertolini | |
| 3,754,420 | A | | 8/1973 | Oellerich | |
| 3,765,197 | A | | 10/1973 | Foote | |
| 3,771,338 | A | | 11/1973 | Raskin | |
| 3,772,645 | A | | 11/1973 | Odenz et al. | |
| 3,782,146 | A | | 1/1974 | Franke | |
| 3,785,183 | A | | 1/1974 | Sander | |
| 3,798,934 | A | | 3/1974 | Wright et al. | |
| 3,826,510 | A | | 7/1974 | Halter | |
| D232,416 | S | | 8/1974 | Gazda et al. | |
| 3,859,826 | A | | 1/1975 | Singer et al. | |
| 3,866,873 | A | | 2/1975 | Bohli | |
| 3,875,645 | A | | 4/1975 | Tucker et al. | |
| 3,910,079 | A | | 10/1975 | Gassaway | |
| 3,986,780 | A | | 10/1976 | Nivet | |
| 3,990,276 | A | | 11/1976 | Shontz | |
| 3,999,410 | A | | 12/1976 | Hall | |
| 4,003,228 | A | | 1/1977 | Lievens et al. | |
| 4,004,440 | A | | 1/1977 | Dreyer | |
| 4,007,613 | A | | 2/1977 | Gassaway | |
| 4,018,339 | A | | 4/1977 | Pritz | |
| 4,028,913 | A | | 6/1977 | Falk | |
| 4,028,916 | A | | 6/1977 | Pender | |
| 4,047,748 | A | | 9/1977 | Whaley et al. | |
| 4,055,973 | A | | 11/1977 | Best | |
| 4,057,984 | A | | 11/1977 | Avaiusini | |
| 4,065,083 | A | | 12/1977 | Gassaway | |
| 4,066,195 | A | | 1/1978 | Dickler | |
| 4,114,409 | A | | 9/1978 | Scire | |
| 4,118,902 | A | | 10/1978 | Saxton | |
| 4,123,922 | A | | 11/1978 | Kuenstler | |
| 4,131,001 | A | | 12/1978 | Gotto | |
| 4,212,175 | A | | 7/1980 | Zakow | |
| 4,223,542 | A | | 9/1980 | Basseches | |
| 4,252,007 | A | | 2/1981 | Kerley | |
| 4,300,371 | A | | 11/1981 | Herwick et al. | |
| 4,311,883 | A | | 1/1982 | Kidney | |
| 4,394,101 | A | | 7/1983 | Richer | |
| 4,418,550 | A | | 12/1983 | Hamilton | |
| 4,419,034 | A | | 12/1983 | DiMartino | |
| 4,442,571 | A | | 4/1984 | Davis et al. | |
| 4,448,049 | A | | 5/1984 | Murray | |
| 4,462,233 | A | | 7/1984 | Horetzke | |
| 4,471,980 | A | * | 9/1984 | Hickman | 292/19 |
| 4,527,405 | A | | 7/1985 | Renick | |
| 4,570,465 | A | | 2/1986 | Bennett | |
| 4,584,856 | A | | 4/1986 | Petersdorff | |
| 4,603,829 | A | | 8/1986 | Koike et al. | |
| 4,616,490 | A | | 10/1986 | Robbins | |
| 4,640,106 | A | | 2/1987 | Derman | |
| 4,655,057 | A | | 4/1987 | Derman | |
| 4,667,491 | A | | 5/1987 | Lokken et al. | |
| 4,676,080 | A | | 6/1987 | Schwarz | |
| 4,680,949 | A | * | 7/1987 | Stewart | 70/14 |
| 4,685,312 | A | | 8/1987 | Lakoski | |
| 4,691,891 | A | | 9/1987 | Dionne | |
| 4,704,881 | A | | 11/1987 | Sloop, Sr. | |
| 4,733,840 | A | | 3/1988 | D'Amore | |
| 4,738,428 | A | * | 4/1988 | Themistos | 248/551 |
| 4,741,185 | A | | 5/1988 | Weinert et al. | |
| 4,768,361 | A | | 9/1988 | Derman | |
| 4,779,434 | A | | 10/1988 | Derman | |
| 4,801,232 | A | | 1/1989 | Hempel | |
| 4,805,426 | A | | 2/1989 | Dimmick et al. | |
| 4,826,193 | A | | 5/1989 | Davis | |
| 4,842,912 | A | | 6/1989 | Hutter, III | |
| 4,843,848 | A | | 7/1989 | Igelmund | |
| 4,856,304 | A | | 8/1989 | Derman | |
| 4,856,305 | A | | 8/1989 | Adams | |
| 4,858,455 | A | | 8/1989 | Kuo | |
| 4,862,716 | A | | 9/1989 | Derman | |
| 4,870,840 | A | | 10/1989 | Klein | |
| 4,893,488 | A | | 1/1990 | Klein | |
| 4,907,111 | A | | 3/1990 | Derman | |
| 4,907,716 | A | | 3/1990 | Wankel et al. | |
| 4,918,952 | A | | 4/1990 | Lakoski | |
| 4,924,683 | A | | 5/1990 | Derman | |
| 4,938,040 | A | | 7/1990 | Humphreys, Jr. | |
| 4,959,635 | A | | 9/1990 | Wilson | |
| 4,959,979 | A | | 10/1990 | Filipow | |
| 4,979,382 | A | | 12/1990 | Perry | |
| 4,985,695 | A | | 1/1991 | Wilkinson et al. | |
| 4,986,097 | A | | 1/1991 | Derman | |
| 4,993,244 | A | | 2/1991 | Osman | |
| 5,001,854 | A | | 3/1991 | Derman | |
| 5,010,748 | A | | 4/1991 | Derman | |
| 5,022,242 | A | | 6/1991 | Povilaitis | |
| 5,024,072 | A | | 6/1991 | Lee | |
| 5,027,627 | A | | 7/1991 | Derman | |
| 5,050,836 | A | | 9/1991 | Makous | |
| 5,052,199 | A | | 10/1991 | Derman | |
| 5,063,763 | A | | 11/1991 | Johnson | |
| 5,076,079 | A | | 12/1991 | Monoson et al. | |
| 5,082,232 | A | | 1/1992 | Wilson | |
| 5,082,233 | A | | 1/1992 | Ayers et al. | |
| 5,119,649 | A | | 6/1992 | Spence | |
| 5,184,798 | A | | 2/1993 | Wilson | |
| 5,197,706 | A | | 3/1993 | Braithwaite et al. | |
| 5,228,319 | A | | 7/1993 | Holley et al. | |
| 5,279,136 | A | | 1/1994 | Perry | |
| 5,327,752 | A | | 7/1994 | Myers et al. | |
| 5,349,834 | A | | 9/1994 | Davidge | |
| 5,351,507 | A | | 10/1994 | Derman | |
| 5,351,508 | A | | 10/1994 | Kelley | |
| 5,361,610 | A | | 11/1994 | Sanders | |
| 5,370,488 | A | | 12/1994 | Sykes | |
| 5,381,685 | A | * | 1/1995 | Carl | 70/78 |
| 5,390,514 | A | | 2/1995 | Harmon | |
| 5,390,977 | A | | 2/1995 | Miller | |
| 5,398,530 | A | | 3/1995 | Derman | |
| 5,400,622 | A | * | 3/1995 | Harmon | 70/14 |
| 5,406,809 | A | | 4/1995 | Igelmund | |
| 5,412,959 | A | | 5/1995 | Bentley | |
| 5,421,667 | A | | 6/1995 | Leyden et al. | |
| 5,466,022 | A | | 11/1995 | Derman | |
| 5,489,173 | A | | 2/1996 | Hofle | |

| | | | |
|---|---|---|---|
| 5,520,031 | A | 5/1996 | Davidge |
| D370,473 | S | 6/1996 | Derman |
| 5,579,657 | A | 12/1996 | Makous |
| 5,603,416 | A | 2/1997 | Richardson et al. |
| 5,608,605 | A | 3/1997 | Siow et al. |

FOREIGN PATENT DOCUMENTS

| | | | |
|---|---|---|---|
| DE | 3824393 | | 7/1989 |
| DE | 3824393 | C1 | 7/1989 |
| DK | 456219 | | 2/1921 |
| FR | 45574 | | 3/1913 |
| FR | 455740 | | 3/1913 |
| FR | 877220 | | 12/1942 |
| FR | 1085107 | | 6/1953 |
| FR | 1026519 | | 10/1990 |
| GB | 447091 | | 5/1936 |
| GB | 1256295 | | 12/1971 |
| IT | 451949 | | 10/1949 |
| NO | 14095 | | 11/1904 |

OTHER PUBLICATIONS

Kensington Product Brochure for Kensington Apple®, LaserWriter® and Macintosh® Portable Security Systems.

*Computer and Office Equipment Security Catalog*, ©1990 by Secure–It, Inc. 18 Maple Court, East Longmeadow, MA 01028.

Apple Security Bracket Sold in AS Kit.

Retaining Device Incorporated in Apple Computer.

* cited by examiner

SECURITY DEVICE FOR A PORTABLE COMPUTER

This application is a continuation of and claims the benefit of U.S. application Ser. No. 08/744,890, filed Nov. 8, 1996 now U.S. Pat. No. 6,112,561, the disclosure of which is incorporated by reference.

BACKGROUND OF THE INVENTION

The present invention relates generally to devices for inhibiting the theft of relatively small but expensive pieces of equipment. More specifically, the invention relates to a lock interface for a specially designed slot having predetermined dimensions.

Computers have evolved rather rapidly from large, expensive machines usable only by a few, to relatively small, portable machines which are usable by many. In particular, the development of desktop computers with significant processing power has made computers available to the general population. It is now common for college and even high school students to have their own computer, and desktop computers are in wide spread use as word processors and work stations in almost all forms of business. Desktop computers are relatively small and easily transportable, and an undesirable side effect of their proliferation is the fact that the theft of such computers is a significant problem.

A variety of devices have been developed to inhibit the theft of desktop computers and similar equipment. Since desktop computer systems involve several components, typically including the computer itself, a separate monitor, keyboard and often a printer, such security systems often employ a cable which attaches each of the components to each other and to a relatively immovable object such as a desk. The principal difficulty in such systems is providing an effective and convenient method for attaching the cable itself to the equipment.

Kensington Microware Limited, assignee of this application, currently provides a security system which is especially designed for use with particular Apple computers. Certain Apple computer components have slots and internal brackets designed to capture a specially designed tab inserted through the slot so that the tab is not removable. While this system is effective for particular types of Apple computers, it does not work for those Apple computer components and other computer brands which do not have the special designed slots and brackets.

It is undesirable to require a computer to have specially designed slots and internal capture brackets because the brackets occupy a significant amount of space in an item of equipment which is intended to be as space efficient as possible. Different items of Apple equipment require different sized slots, meaning that the security mechanism must provide a variety of different sized tabs. The tabs, once inserted, cannot be removed without damage to the equipment, meaning that the security system cannot be moved from one computer to the other. Even Apple computers with specially designed slots are typically used with peripheral equipment which does not have them, and, the Kensington system provides screws requiring a special screwdriver which replace the screws used to attach the existing communication cables, securing the peripheral equipment to the base computer by preventing unauthorized removal of the communication cables. This last aspect of the system has a drawback in that the peripheral equipment cannot be removed from the base computer without the special screwdriver, which can be lost or misplaced.

Other vendors provide security systems which are not required to interface directly with special slots and capture mechanisms as provided in certain Apple computers. For example, Secure-It, Inc., under the trademark "KĂBLIT", provides a variety of brackets attached to the computer component using existing mounting screws, i.e., screws which are already used to secure items of equipment within the cabinet. Typically, the bracket is apertured so that passage of the cable through the aperture prevents access to the mounting screw and thus prevents removal of the bracket from the equipment. A deficiency of this type of system is that it requires the removal of the existing mounting screw, which may cause some damage to the internal components of the computer. Suitable existing screws are not always available on certain peripherals for convenient attachment of the fastener. For this latter reason, KĂBLIT also provides glue-on disks which, unfortunately, are permanently secured to the equipment.

The theft of small but expensive equipment such as desktop or laptop computers is a growing problem. Existing devices are simply too inefficient or ineffective, or their application is too limited. As a result, the use of such security systems is rare, computer equipment is typically left unprotected, and it is all too often stolen.

SUMMARY OF THE INVENTION

The present invention provides a simple yet efficient solution to the prior art problem of inhibiting theft of portable equipment. Specifically, the present invention discloses lock interfaces for a specially designed slot having predetermined dimensions and methods of providing a locking interface to a specially designed slot.

In a preferred embodiment, a locking interface for the specially designed slot includes two legs pivotably coupled together about an articulation point. The two legs each have opposing flanges on a first end and handles on a second end. The two legs define a first and a second position, with the flanges and legs adapted for insertion and removal when in the first position. The flanges engage an inner surface of the wall when the legs are in the second position. The preferred embodiment includes a retainer that is coupled to the handles of the first and second legs that retain the legs in the second position when the flanges engage the inner surface.

In the preferred embodiment, the handles define an aperture and an object extends through the aperture to hold the legs in the second position. The object may be any suitable object, including a cable or shackle of a lock.

In operation, a user operates the first and second legs into the first position, inserts the legs into the slot, operates the handles to move the legs to the second position so that the flanges engage the slot. Thereafter, a retainer is coupled to the handles so as to hold the legs in the second position. The retainer may be a cable extending through an aperture defined by the handles of the legs, though other similar objects may be used.

Further understanding of the nature and advantages of the invention may be realized by reference to the remaining portions of the Specification and Drawings. In the drawings, similarly numbered items represent the same or functionally equivalent structures.

DETAILED DESCRIPTION OF SPECIFIC EMBODIMENTS

Figure 1:
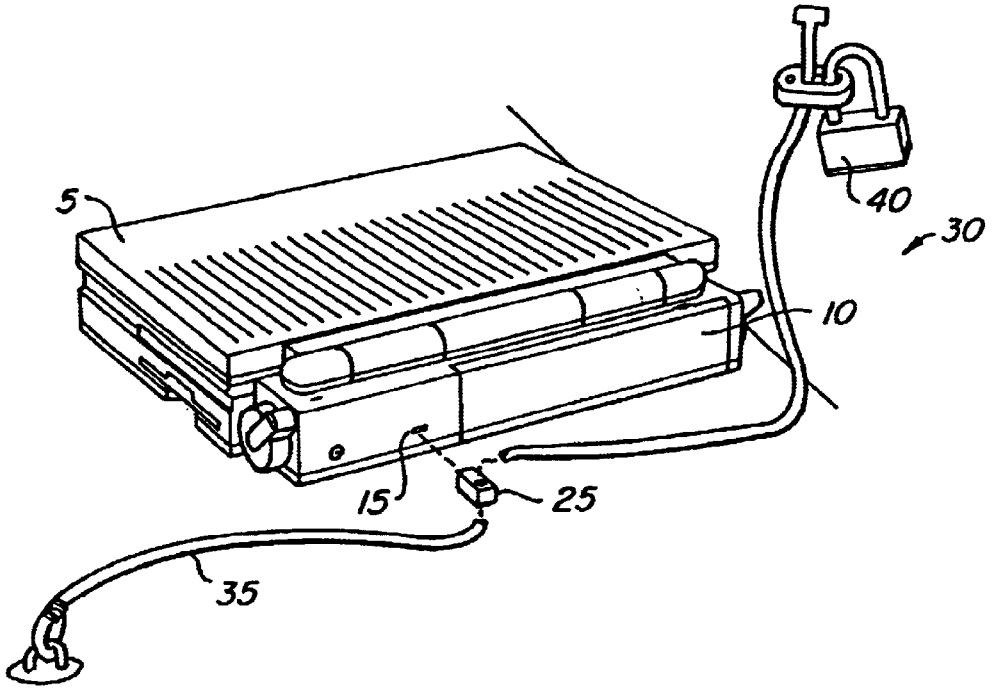
FIG. 1 illustrates a typical use of an embodiment of the present invention.

FIG. 1 illustrates a typical use of an embodiment of the present invention. A portable computer 5 has a wall 10 provided with a slot 15. Wall 10 includes an inner surface 20. A lock interface 25 is engageable with wall 10 through slot 15. A locking mechanism 30, according to the preferred embodiment, includes a cable 35 and a lock 40. In operation, a user inserts lock interface 25 into slot 15 and engages lock interface 25 with inner surface 20. Once engaged, a user can attach lock interface 25 to a stationary object with cable 35 and lock 40.

Figure 2:
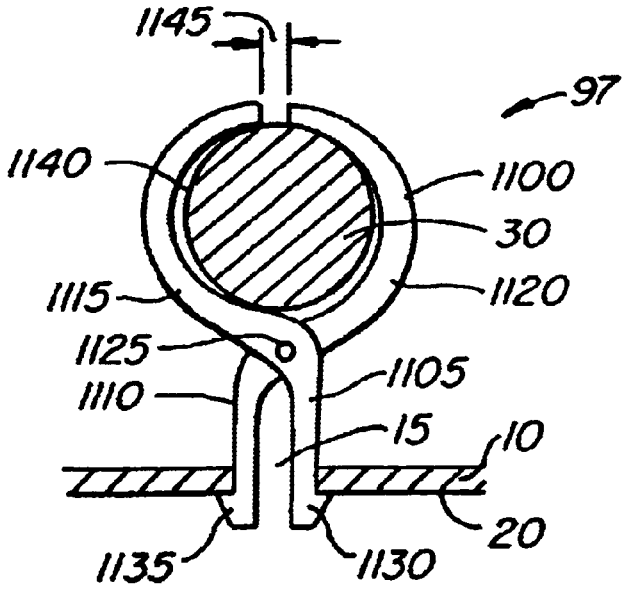
FIG. 2 illustrates another embodiment of lock interface.

FIG. 2 is a preferred embodiment of lock interface 97. Lock interface 97 includes an engagement member 1100. Engagement member 1100 includes a first leg 1105, a second leg 1110, a first handle 1115, a second handle 1120, and an articulation point 1125. First leg 1105 includes a flange 1130 at a distal end that is flanged away from second leg 1110, and second leg 1110 includes a flange 1135 at a distal end that is flanged away from first leg 1105. First handle 1115 and second handle 1120 are curved towards each other to define an aperture 1140 and are separated by a space 1145.

Figure 3:
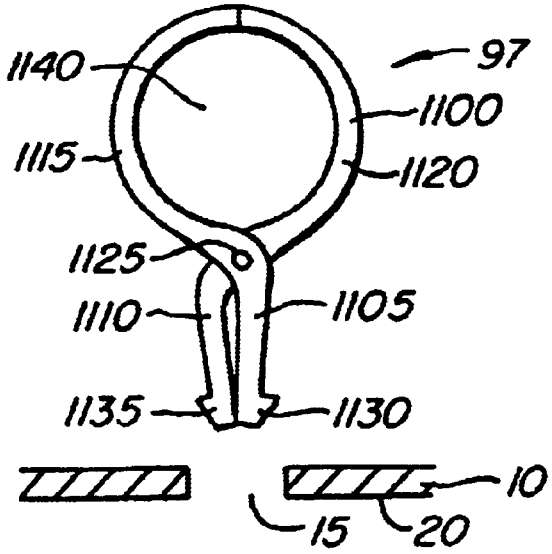
FIG. 3 is another view of the lock interface in FIG. 2 with the first leg and the second leg in the first position.

First leg 1105 and second leg 1110 are coupled to each other at articulation point 1125. When first leg 1105 and second leg 1110 move towards each other, defining a first position, first handle 1115 and second handle 1120 are moved towards each other by the distance of space 1145, and when first handle 1115 and second handle 1120 are moved away from each other, first leg 1105 and second leg 1110 move away from each other, defining a second position. FIG. 3 is another view of the lock interface in FIG. 2 with first leg 1105 and second leg 1110 in the first position. When first leg 1105 and second leg 1110 are in the first position, flange 1130 and flange 1135 are insertable and removable from slot 15. FIG. 2 illustrates that when first leg 1105 and second leg 1110 are in the second position, flange 1130 and flange 1135 are engageable with inner surface 20.

In operation, a user moves first handle 1115 and second handle 1120 towards each other, causing first leg 1105 and second leg 1110 to move into the first position, and inserts flange 1130 and flange 1135 into slot 15. Moving first handle 1115 and second handle 1120 away from each other causes first leg 1105 and second leg 1110 to move into the second position, allowing engagement of flange 1130 and flange 1135 with inner surface 20. Inserting a locking mechanism 30 through aperture 1140 maintains positioning of first handle 1115 and second handle 1120, maintains positioning of first leg 1105 and second leg 1110 in the second position, and can be used to lock the computer 5 to a stationary object.

In the foregoing specification, the invention has been described with reference to a specific exemplary embodiments thereof. It will, however, be evident that various modifications and changes may be made thereunto without departing from the broader spirit and scope of the invention as set forth in the claims.

Many changes or modifications are readily envisioned, for example, changing the shape of the slot and the shape of the head portion, adding catches to the engagement members, and changing the shape of the flanges among other changes. Additionally, where a cable is shown, some other type of rigid, non-compressible object can be used to maintain the flange in the locked position. The specification and drawings are, accordingly, to be regarded in an illustrative rather than in a restrictive sense.

What is claimed is:

1. A locking interface comprising:

a portable electronic device having a wall defining a security slot, said security slot having a predetermined shape, and said wall including an inner surface;

a first leg and a second leg, pivotally coupled together to rotate within a plane of rotation about an articulation point defined by a pin, each of said legs having opposing flanges extending from a respective leg and included within said plane of rotation, said opposing flanges included on a first end and opposing handles on a second end of each of said legs, said first leg and said second leg having a first position and a second position, said opposing flanges of said legs adapted for concurrent insertion and removal from said security slot when in said first position, and said opposing flanges of said first leg and said second leg adapted for engagement with said inner surface when in said second position; and a retainer, interactively coupled to said opposing handles, adapted for retaining said first leg and said second leg in said second position.

2. The locking interface of claim 1 wherein said opposing handles define an aperture and wherein said retainer is an object passing through said aperture.

3. The locking interface of claim 2 wherein said retainer is a cable passing through said aperture.

4. The locking interface of claim 1 wherein said security slot is approximately 7 mm in length and approximately 3 mm in width.

5. A locking interface comprising:

a portable electronic device having a wall defining a security slot, said security slot having a predetermined shape, and said wall including an inner surface;

a first and a second leg, pivotally coupled together to rotate within a plane of rotation about an articulation point defined by a pin, each of said legs having opposing flanges extending from a respective leg and included within said plane of rotation, said opposing flanges included on a first end and opposing handles on a second end of each of said legs, said first leg and said second leg having a first position and a second position, said opposing flanges of said legs adapted for concurrent insertion and removal from said security slot when in said first position, and said opposing flanges of said first leg and said second leg adapted for engagement with the inner surface when in said second position; and means, interactively coupled to said opposing handles, for retaining said first leg and said second leg in said second position.

6. The locking interface of claim 5 wherein said security slot is approximately 7 mm in length and approximately 3 mm in width.

7. A locking interface comprising:

a portable electronic device having a wall defining a security slot, said security slot having a predetermined shape, and said wall including an inner surface; and a first and a second leg, pivotally coupled together to rotate within a plane of rotation about an articulation point defined by a pin, each of said legs having opposing flanges extending from a respective leg and included within said plane of rotation, said opposing flanges included on a first end and opposing handles on a second end of each of said legs, said first leg and said second leg having a first position and a second position, said opposing flanges of said legs adapted for concurrent insertion and removal from said security slot when in said first position, and said opposing flanges of said first leg and said second leg adapted for engagement with said inner surface when in said second position, said opposing handles of said first leg and said second leg cooperatively defining an aperture, wherein said legs are adapted for inhibiting said legs from moving from said second position to said first position when an object extends through said aperture.

8. The locking interface of claim 7 wherein said security slot is approximately 7 mm in length and approximately 3 mm in width.

9. A system for inhibiting theft, comprising:

a portable electronic device having a wall defining a security slot, said security slot having a predetermined shape, and said wall including an inner surface;

an attaching apparatus including:

a first leg and a second leg, pivotally coupled to rotate within a plane of rotation about an articulation point defined by a pin, said legs each having a flange at a first end, with said flange of said first leg oppositely directed in relation to said flange of said second leg and extending within said plane of rotation, said legs each having a second end with said articulation point intermediate said first end and said second end, said legs together defining an unlocked position and a locked position wherein said first ends of said legs are adapted to be inserted into said security slot and removed from said security slot when in said unlocked position, and retained in said security slot when in said locked position, said second ends defining an aperture when in said unlocked position, and said second ends separating to define an widened aperture when in said locked position, such that an object passing through said widened aperture when said legs are in said locked position inhibits articulation of said legs to said unlocked position; and a first object passing through said widened aperture for attaching to a second object other than said portable electronic device;

wherein said security slot is approximately 7 mm in length and approximately 3 mm in width.

10. An attachment apparatus for inhibiting theft of a portable device, comprising:

means for pivotally engaging a specially designed security slot of a the portable device, said security slot having a predetermined shape and said means for engaging having an axis of rotation defined by a pin wherein said axis of rotation does not pass through said security slot; and means, coupled to said engaging means, for securing said engaging means to an object other than said specially designed security slot without operationally interfering with the portable device to inhibit movement of the portable device beyond a predetermined distance from said object, wherein said security slot is approximately 7 mm in length and approximately 3 mm in width.

11. A locking mechanism for attaching to a rectangular security slot of a portable electronic device wherein said security slot includes a portion that is approximately 7 mm in length and approximately 3 mm in width, comprising:

a first member and a second member, pivotally coupled to each other about an articulation point defined by a pin, each of said members having an engagement flange on a first end and handles on a second end, said first member and said second member relatively defining a first position and a second position, wherein said engagement flanges are sized so as to be insertable into the security slot when said members are rotated to said first position and said flanges lengthwise align with the slot and wherein said engagement flanges extend beyond a perimeter of the security slot when said members are rotated to said second position so that said members are retained within the security slot by said flanges; and a retainer, coupled to said handle of said first member and to said handle of said second member when said members are in said second position for inhibiting movement of said members to said first position.

12. The locking interface of claim 11 wherein said means includes a cable passed through an aperture provided by said handles.

* * * * *